United States Patent [19]

Melys

[11] Patent Number: 4,497,987

[45] Date of Patent: Feb. 5, 1985

[54] KEYBOARD SPACER

[75] Inventor: Aleksandras A. Melys, Hillside, N.J.

[73] Assignee: Sweda International, Inc., Pine Brook, N.J.

[21] Appl. No.: 251,410

[22] Filed: Apr. 6, 1981

[51] Int. Cl.[3] ..... H01H 9/28

[52] U.S. Cl. ..... 200/42 R; 400/663

[58] Field of Search ..... 200/328, 327, 334, 42 R, 200/42 T, 340; 400/677, 663; 411/513, 508, 516; 24/563

[56] References Cited

U.S. PATENT DOCUMENTS

| | | | |
|---|---|---|---|
| 1,316,587 | 9/1919 | Miller | 74/527 |
| 2,960,742 | 11/1960 | Solomon | 24/255 R |
| 3,231,791 | 1/1966 | Parris | 200/42 T |
| 3,678,236 | 7/1972 | Hughes | 200/328 |
| 3,881,313 | 5/1975 | Kanlins | 200/52 R |

FOREIGN PATENT DOCUMENTS

| | | | |
|---|---|---|---|
| 2457510 | 6/1976 | Fed. Rep. of Germany | 400/663 |

*Primary Examiner*—John W. Shepperd

*Attorney, Agent, or Firm*—Robert F. Rotella; Michael H. Wallach

[57] ABSTRACT

A keyboard spacer for inhibiting the depression of selected push buttons upon a keyboard is shown including a longitudinal trunk having a first resilient arm which engages a key stem of a keyboard switch between the switch and the push button. As the first resilient arm yields, a second latching arm snaps over the key stem for retaining the spacer in the position desired. The spacer, which inhibits the depression of the push button, may be easily removed if push button operation is desired.

10 Claims, 4 Drawing Figures

KEYBOARD SPACER

The present invention relates to a keyboard spacer which inhibits the depression of individual keys upon a keyboard.

BACKGROUND OF THE INVENTION

Keyboards of various kinds have been utilized for many years to permit the manual encoding of information. A well known example of an early keyboard is the manual typewriter wherein each key button may be depressed to mechanically imprint the alphanumeric character desired upon a piece of paper. Mechanical linkages between the key button and the mechanical arm bearing the desired character were later replaced with an electrical switch which energizes a motor driven arm. With the increasing capability of electronics and the development of computers, a typical typewriter keyboard may be utilized in an ever increasing number of devices for encoding information including cash registers, calculators and word processors.

The flexibility of electronics often enabled the same keyboard to be utilized in the different devices mentioned. Often, the same device with the same keyboard may be sold into different countries, with different alphanumeric characters upon the various keys.

Thus, depending on the function of the keyboard desired, different keys or push buttons can be labeled with varying alphanumeric characters. Some of these keys or push buttons can be placed upon the keyboard and then inhibited from operation depending upon the equipment in which the keyboard is to be installed, the desired function of that equipment, and the country into which the equipment is to be sold. Once the equipment is in field operation, it may be desired to modify the equipment to change the alphanumeric character upon the keyboard, to enable one of the disabled keys or to disable another.

The prior art addresses, the problem of modifying the functions of operating keys upon a keyboard in U.S. Pat. No. 4,119,839 by U. L. Beckmann, et al. It is also known to inhibit the manual depression of one key when an adjacent key has been depressed or to retain one key in a depressed position until the depression of an adjacent key. See for example U.S. Pat. No. 3,412,221 by A. A. DiPilla which utilizes a clip to prevent the depression of one key when an adjacent key is depressed. See also U.S. Pat. No. 3,626,120 by D. H. Wright which retains one key in a depressed position until an adjacent key has been depressed.

None of these devices nor any device currently known teach the utilization of an economic keyboard spacer which may be easily installed or removed from beneath a key button to respectively inhibit or enable manual operation of the keyboard switch.

SUMMARY OF THE INVENTION

Accordingly, it is an object of the present invention to provide economic keyboard spacer which may be easily installed or removed to inhibit or enable the operation of a selected number of push buttons upon a keyboard.

Another object of the invention is to provide an economic keyboard spacer which is not easily observed by the operator of the keyboard to prevent tampering, which may be factory installed to permit a common keyboard to be easily modified for various applications, and which permits economic field modifications of the keyboard should such modifications become desirable.

In accomplishing these and other objects, there is provided a keyboard spacer which fits between a keyboard switch and a push button about the key stem joining the switch to the button. The spacer includes a longitudinal trunk portion having a first resilient arm portion extending at an angle from its trunk to resiliently engage the key stem. A second latching arm portion extends from the longitudinal trunk and fits about the key stem to retain the spacer in the desired position. The trunk is longitudinally extended adjacent the resilient arm portion to permit an insertion and removal tool to grip the spacer.

DESCRIPTION OF THE DRAWINGS

Other objects and further advantages of the present invention will become apparent after careful consideration of the following specification and accompanying drawings, wherein.

DESCRIPTION OF THE PREFERRED EMBODIMENT

Figure 1:
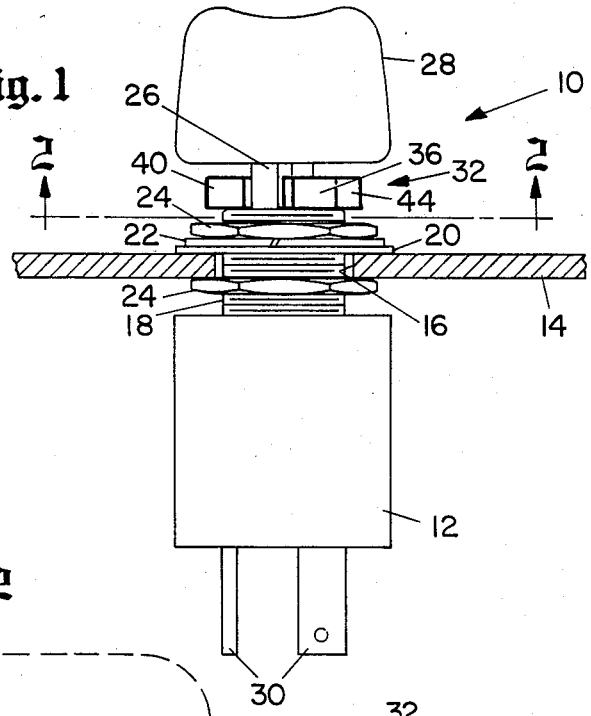
FIG. 1 is a side elevational view of a keyboard system utilizing a keyboard spacer of the present invention.

Referring now to the drawings, FIG. 1 shows a keyboard system 10 including a plurality of keyboard switches 12 mounted upon a keyboard 14 having a plurality of apertures 16 therein. The keyboard switch 12 includes an tubular, threaded bushing 18 which fits through the aperture 16 within board 14 to receive a flat washer 20, lock washers 22 and retaining nut 24. While the utilization of washers 20 and 22 and nut 24 is a typical mounting arrangement, it will be understood that other arrangements may be utilized to mount the switch 12 upon board 14.

Figure 4:
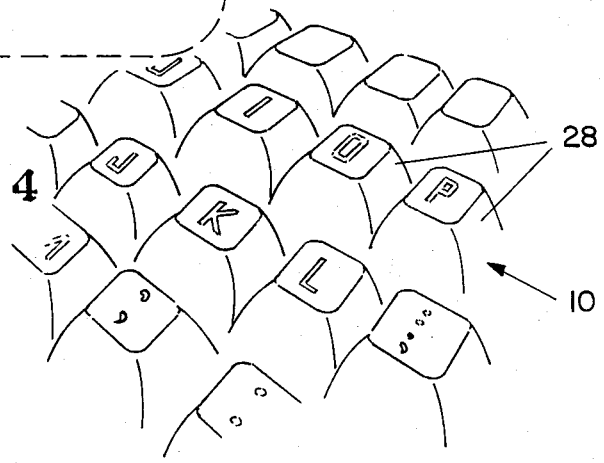
FIG. 4 is a prospective view showing a portion of a typical keyboard incorporating the present invention.

Extending through the center of threaded bushing 18 is a key stem 26 which extends beyond the bushing 18 for receiving a key button or push button 28 which is retained upon the stem 26 by a forced fit. A typical push button 28 may be skirted with the upper surface of the button having a square face with rounded corners that increase in dimension toward the lower surface. The upper surface of the push button 28 is generally concaved to permit the easy contact of an operator's fingers. This surface may then be engraved or otherwise marked with alphanumeric characters, as shown in FIG. 4. As it is well known, depression of the push button 28 causes the key stem 26 to move in a downward direction for closing a normally opened switch located within the keyboard switch 12. Closure of the normally open switch closes a contact across a pair of terminals 30 to provide a path for electrical current to flow to a printing or encoding device used within a typewriter, word processor, cash register, or calculator.

The typical keyboard in the equipment described above is manufactured with a plurality of keyboard switches 12. Depending upon the equipment, the number of switches required may vary. Even within the same equipment, such as a typewriter, it is desired to utilize different alphanumeric characters for different purposes. An accountant, for example, may require a variety of symbols not needed by a librarian who might wish to have a different set of symbols especially if correspondence is to be carried on in foreign language. To accomodate the different type set required within the particular typewriter, the push buttons 28 may be replaced to represent an accounting symbol or an accent symbol. Further, different functions of the same typewriter may require a particular switch whereas other functions will not. Thus, it may be desirable to inhibit or enable a particular push button depending upon the function of the equipment in which the push button is utilized.

As seen in FIG. 1, a keyboard spacer 32 may be inserted between the keyboard switch 12 and key button 28 about the key stem 26. This spacer 32, best seen in FIGS. 1 through 3, comprises a longitudinal trunk 34 having a generally rectangular cross section the thickness of which inhibits the depression of the push button 28 when in the position shown in FIGS. 1 or 2.

The keyboard spacer 32 may be molded or extruded from a suitable resilient plastic resin such as a phenylene oxide. Phenylene oxide is especially desirable as it has excellent mechanical properties over temperature ranges below −40° F. to above 300° F. The material is self extinguishing, nondripping with excellent dimensional stability, low creep, high modulus and low water absorption. Further, the material has good electrical properties, excellent resistance to acqueous chemical environment, is easily processed with injection molding or extrusion equipment and has excellent impact strength. This material may be commerically obtained from various sources. While phenylene oxide is a preferred material, it will be understood that other resins are also suitable for use in the present invention.

Figure 2:
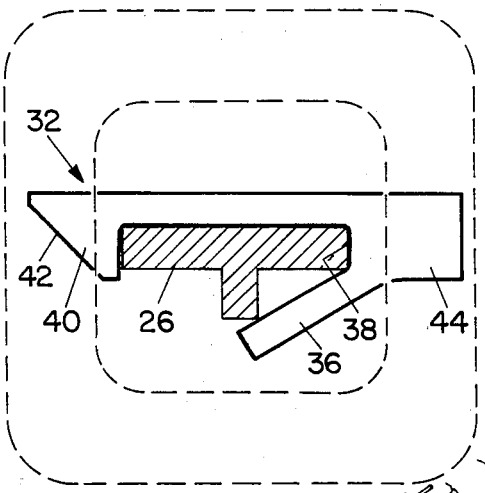
FIG. 2 is a cross sectional view taken along lines 2—2 of FIG. 1.
Figure 3:
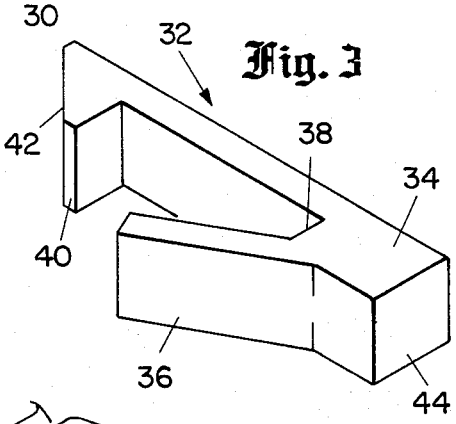
FIG. 3 is a prospective view showing the keyboard spacer of the present invention.

As seen in FIG. 2, the longitudinal trunk 34 which forms spacer 32 includes a first resilient arm portion 36 which extends at an angle of approximately 30° from the longitudinal axis of the trunk 34. This resilient arm 36 has a generally thin cross section to enhance its flexibility. The inner surface of the resilient arm 36 forms a notch 38 which is perpendicular to the longitudinal axis of trunk 34. The width of notch 38 is molded or extruded to match the thickness of key arm 26. In the embodiment shown in FIG. 2, the cross section of the key arm 26 is a T-section wherein the lower portion of the T rests against the inner surface of resilient arm 26. In other embodiments, where a rectangular cross section of stem 36 is utilized, the depth of notch 38 may be made slightly less than the thickness of the stem 26 to permit a resilient engagement. In such an embodiment, the length of the stem 36 may be foreshortened.

The longitudinal trunk 34 extends along the upper surface of the T-section of key stem 26 and terminates at a second latching arm portion 40 whose latching surface is parallel to the surface of notch 38 and perpendicular to the longitudinal axis of trunk 34. The outer end of the latching portion 40 is chamferred at 42 to provide the keyboard spacer 32 with a tapering end for easy insertion between the keyboard switch 12 and push button 28 about key stem 26.

Installation and removal of the spacer 32 is aided by a wide trunk portion 44 which extends along the longitudinal axis of the spacer trunk 34. The extension of the wide trunk portion 44 is generally shorter than the width of the lower surface of push button 28 to permit the spacer 32 to remain hidden under the bottom 28. The trunk portion 44 may be engaged by an installation and removal tool such as long nosed pliers, straight tweezers or a specially adopted tool. Installation is accomplished by inserting the chamferred end 42 of spacer 32 between the key button 28 and key switch 12. As arm 36 engages stem 26, the arm 40 is snapped around key stem 26 where it is retained by the resiliency of arm 36. Removal is accomplished by gripping the wide trunk portion 44 with the removal tool and twisting the spacer 32 in a clockwise direction. This twisting motion disengages the second latching portion 40 from the stem 26 and permits the removal of the spacer 32.

From the foregoing description, it will be understood that the first resilient arm 36 provides the resilient force which retains the spacer 32 in the desired position about key stem 26. The thickness of the spacer 32 may be varied by simply adjusting the thickness of the cut made from a suitable extrusion, for example. While the key stem 26 has been shown with a T-section, it will be understood that the keyboard spacer of the present invention will also fit about other key stem configurations, including a rectangular cross section or square cross section. Accordingly, the keyboard spacer of the present invention should be limited only by the appended claims.

I claim:

1. A keyboard spacer for inhibiting the depression of a push button of a keyboard switch having a key stem, comprising:

a trunk portion, the thickness of which inhibits the depression of said push button switch mounted upon said keyboard;

a first resilient arm portion extending from said trunk portion for yieldably engaging said key stem as said spacer is inserted between said push button and said keyboard;

a second latching arm portion extending from said trunk portion and engaging said key stem for latching said spacer between said push button and said keyboard wherein said first resilient arm portion retains said spacer in said latched position.

2. A keyboard spacer, as claimed in claim 1, wherein said trunk portion includes a longitudinal extension for engagement by installation and removal means.

3. A keyboard spacer, as claimed in claim 1, wherein said first resilient arm portion includes a lateral extension which extends at an angle to the longitudinal axis of said trunk portion.

4. A keyboard spacer, as claimed in claim 3, wherein said second latching arm portion includes a lateral extension which extends perpendicularly to the longitudinal axis of said trunk portion.

5. A keyboard spacer, as claimed in claim 4, wherein said angular extension of said first resilient arm portion urges said second latching arm portion against said keyboard switch for retaining said spacer in the position desired.

6. In a keyboard system having a plurality of push button switches mounted upon a board, each with a key stem extending through said board from said switch to said push button, a keyboard spacer for inhibiting depression of a selected number of said plurality of push buttons, comprising:

a trunk portion having a longitudinal axis, the thickness of which fits between said board and said push button to inhibit depression thereof;

a first resilient arm portion extending from said trunk portion at a first angle to said longitudinal axis thereof for resiliently engaging said key stem of said switch;

a second latching arm portion extending from said trunk portion at a second angle to said longitudinal axis thereof for retaining said spacer upon said key stem of said switch under the urging of said first resilient arm portion.

7. In a keyboard system, as claimed in claim 6, wherein said first angle of said first resilient arm portion is an acute angle and said second angle of said second latching arm portion is a right angle.

8. In a keyboard system, as claimed in claim 6, wherein said keyboard spacer is formed from an extruded piece of resilient material cut to said truck thickness desired.

9. In a keyboard system, as claimed in claim 6, wherein said keyboard spacer is extruded from resilient phenylene oxide.

10. In a keyboard system, as claimed in claim 6, wherein said keyboard spacer is formed from a molded piece of resilient material molded to said trunk thickness desired.

* * * * *